US007634964B2

(12) United States Patent
Masuch

(10) Patent No.: US 7,634,964 B2
(45) Date of Patent: Dec. 22, 2009

(54) METHOD FOR DOSING THE QUANTITY OF INK IN THE INKING SYSTEM OF A PRINTING MACHINE

(75) Inventor: Bernd Kurt Masuch, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 82 days.

(21) Appl. No.: 11/579,154

(22) PCT Filed: Apr. 26, 2005

(86) PCT No.: PCT/EP2005/051856

§ 371 (c)(1),
(2), (4) Date: Oct. 31, 2006

(87) PCT Pub. No.: WO2005/108081

PCT Pub. Date: Nov. 17, 2005

(65) Prior Publication Data

US 2008/0011176 A1 Jan. 17, 2008

(30) Foreign Application Priority Data

May 3, 2004 (DE) ..... 10 2004 022 026

(51) Int. Cl.

| | |
|---|---|
| ***B41F 31/02*** | (2006.01) |
| ***B41F 1/34*** | (2006.01) |
| ***B41F 21/12*** | (2006.01) |
| ***B41F 21/14*** | (2006.01) |
| ***B41L 1/02*** | (2006.01) |

(52) U.S. Cl. ..... 101/365; 101/485; 101/DIG. 47

(58) Field of Classification Search ..... 101/365, 101/485, DIG. 47, 484
See application file for complete search history.

(56) References Cited

U.S. PATENT DOCUMENTS

| | | | |
|---|---|---|---|
| 4,193,345 | A | 3/1980 | Schoneberger et al. |
| 4,803,923 | A | 2/1989 | Kenichi |
| 6,634,293 | B2 | 10/2003 | Hoffheinz et al. |

FOREIGN PATENT DOCUMENTS

| | | |
|---|---|---|
| DE | 27 14 577 | 10/1978 |
| DE | 32 04 501 | 10/1983 |

(Continued)

*Primary Examiner*—Judy Nguyen
*Assistant Examiner*—Leo T Hinze
(74) *Attorney, Agent, or Firm*—Jones, Tullar & Cooper, P.C.

(57) ABSTRACT

A quantity of ink is dosed in an inking system of a printing machine, which inking system is provided with at least one dosing device that can be used to modify the quantity of ink which is transferred by the inking system. The dosing device can be adjusted by the use of an adjusting element to modify the quantity of ink that is to be transferred. A modification of the quantity of ink is defined by an adjustment of the adjusting element. The dosing device is adjusted in accordance with a pre-determined correlation between the amount of the adjustment of the adjusting device and the current state of the dosing device. The adjustment of the dosing device is carried out in accordance with the correlation in such a way that a relation between the modification of the quantity of ink caused by the adjustment of the dosing device, and the ink quantity transferred by the dosing device remains essentially constant.

15 Claims, 2 Drawing Sheets

FOREIGN PATENT DOCUMENTS

| | | |
|---|---|---|
| DE | 37 43 646 | 7/1988 |
| DE | 100 32 765 | 4/2001 |
| DE | 100 55 827 | 5/2002 |
| DE | 100 58 606 | 5/2002 |
| GB | 1 587 026 | 3/1981 |
| GB | 2 352 683 | 2/2001 |

METHOD FOR DOSING THE QUANTITY OF INK IN THE INKING SYSTEM OF A PRINTING MACHINE

CROSS-REFERENCE TO RELATED APPLICATIONS

This U.S. patent application is the U.S. national phase, under 35 USC 371, of PCT/EP2005/051856, filed Apr. 26, 2005; published as WO 2005/108081 A1 on Nov. 17, 2005 and claiming priority to DE 10 2004 022 026.3, filed May 3, 2004, the disclosures of which are expressly incorporated herein by reference.

FIELD OF THE INVENTION

The present invention is directed to a method for dosing the quantities of ink in an inking system of a printing press At least one dosing device is provided in the inking system. The dosing device is controlled by an adjustment device to change an amount of ink which is transferred.

BACKGROUND OF THE INVENTION

In generally known printing presses, ink blades are one example of devices which are used in order to allow the quantity of ink which is transferred from the inking system into the printing press to be altered by dosing. To allow such ink regulation, by the use of these dosing devices by operating personnel, adjustment elements, such as, for example, an adjustment wheel or an adjustment console, are provided in the control station of the printing press. By activating these adjustment elements, it is possible for the operating personnel to alter the dosing of the quantity of ink which is transferred to the printing plate or cylinder by the inking system. When an ink blade is used, it is possible for the size of an opening, which is formed between a front edge of the ink blade and an outer circumference of an ink ductor that receives the printing ink to be changed, such as, for example, by entering a certain control value into such an adjusting device.

A disadvantage of the generally known dosing devices is that, when adjusting the adjustment element or elements by a certain amount, a change of equal magnitude is caused in the quantity of the ink which is transferred. If an ink blade is used as the dosing device, this means that the opening between the front edge of the ink blade and the outer circumference of the ink ductor is always changed by the same amount, regardless of the current setting of the ink blade. If the adjustment path of the ink blade is divided into a certain number of partial stages, such as, for example, into 100 such partial stages, then an adjustment by one such partial stage always causes a change of equal magnitude in the opening on the front edge of the ink blade.

This method of dosing quantities of ink is disadvantageous. In cases in which only small quantities of ink are being transferred, a change in the quantity of ink which will be caused by adjusting the adjustment element a certain amount is relatively quite large. On the other hand, if a large quantity of ink is being transferred at the current setting, an adjustment of the adjustment element, by the same corresponding amount, causes only a relatively small change in the resultant quantity of ink that will be dosed, relative to the current quantity of ink being dosed. In other words, this means that, in cases with small amounts of ink transfer, in which a particularly sensitive adjustment is necessary, only rough or large variations in ink dosing are possible. However, in cases with large amounts of ink transfer, an unnecessarily fine or small variation in ink dosing occurs.

DE 100 55 827 A1, DE 100 32 765 A1, and DE 37 43 646 A1 disclose devices for use in adjusting a quantity of ink in ink systems of printing presses. The quantity of ink is changed by dosing systems, which are actuated by actuators that are dependent upon various parameters.

SUMMARY OF THE INVENTION

The object of the present invention is directed to the provision of a method for dosing quantities of ink in an inking system of a printing press while providing for good adjustment of the dosing.

The object is attained in accordance with the present invention by the provision of at least one ink dosing device in an inking system of a printing press and which is usable for controlling an amount of ink transferred. An adjustment element is used to change the quantity of the ink being transferred. A change is input to the adjusting device. This change is dependent on a predetermined correlation between the degree of adjustment of the adjustment device and the current setting of the dosing device. A ratio between the change to the ink transferred, as caused by the dosing device, relative to the amount of the ink currently being transferred can only vary by 2%.

The advantages that are attainable with the present invention lie particularly in the fact that a certain degree of adjustment to the adjustment element does not always result in the same degree of adjustment to the dosing device. Rather, either before or both before and after the input of a change in the ink quantity, by adjusting the adjustment element, the current setting of the dosing device is determined. Subsequently, the dosing device is adjusted dependent upon a predetermined correlation between the degree of adjustment of the adjustment element and the current setting of the dosing device. The determination of the setting of the dosing device may be made either before or after the input of a change in the ink quantity by adjusting the adjustment element.

A predetermined correlation, between a degree of adjustment submitted to the adjustment element, and the current setting of the dosing device, may be formulated as a mathematical function. As a result, and using the method for dosing quantities of ink, in accordance with the present invention, it becomes possible for the current setting of the dosing device, in particular, to be taken into account in such a way that, in cases in which only small quantities of ink are being transferred by the inking system, an adjustment of the adjustment element will cause only very delicate adjustments to the dosing devices. If, on the other hand, very large quantities of ink are already being transferred at the current setting of the inking system, the change in the dosing of ink may be much more substantial, such that even smaller adjustments to the adjustment element lead to larger changes in the dosing of the ink quantity.

In accordance with a preferred embodiment of the present invention, a correlation between the degree of adjustment that is made to the adjustment element, and the current setting of the dosing device is defined in a particular way. A relation between a change in an ink quantity, which is caused by the adjustment to the dosing device, remains essentially constant, relative to the current quantity of ink being transferred by the dosing device, or differs by less than 2%, and in particular, differs by less than 1%.

The constancy of the relative change to the ink quantity preferably should be present over the entire dosing range of the dosing device. This constancy should also be present over the entire adjustment range of the adjustment element.

If an ink blade, which cooperates with an ink ductor in an ink system that is intended for dosing the ink, is used as the dosing device, it is particularly advantageous for a relative change in a layer thickness of the ink layer which is transferred onto the ink ductor to remain constant. In other words, the ratio of the change in layer thickness, which is caused by adjusting the dosing device to the current layer thickness, is always constant.

BRIEF DESCRIPTION OF THE DRAWINGS

A preferred embodiment of the present invention is shown in the drawings and is described in greater detail in the following.

Shown are.

DESCRIPTION OF THE PREFERRED EMBODIMENT

Figure 1:
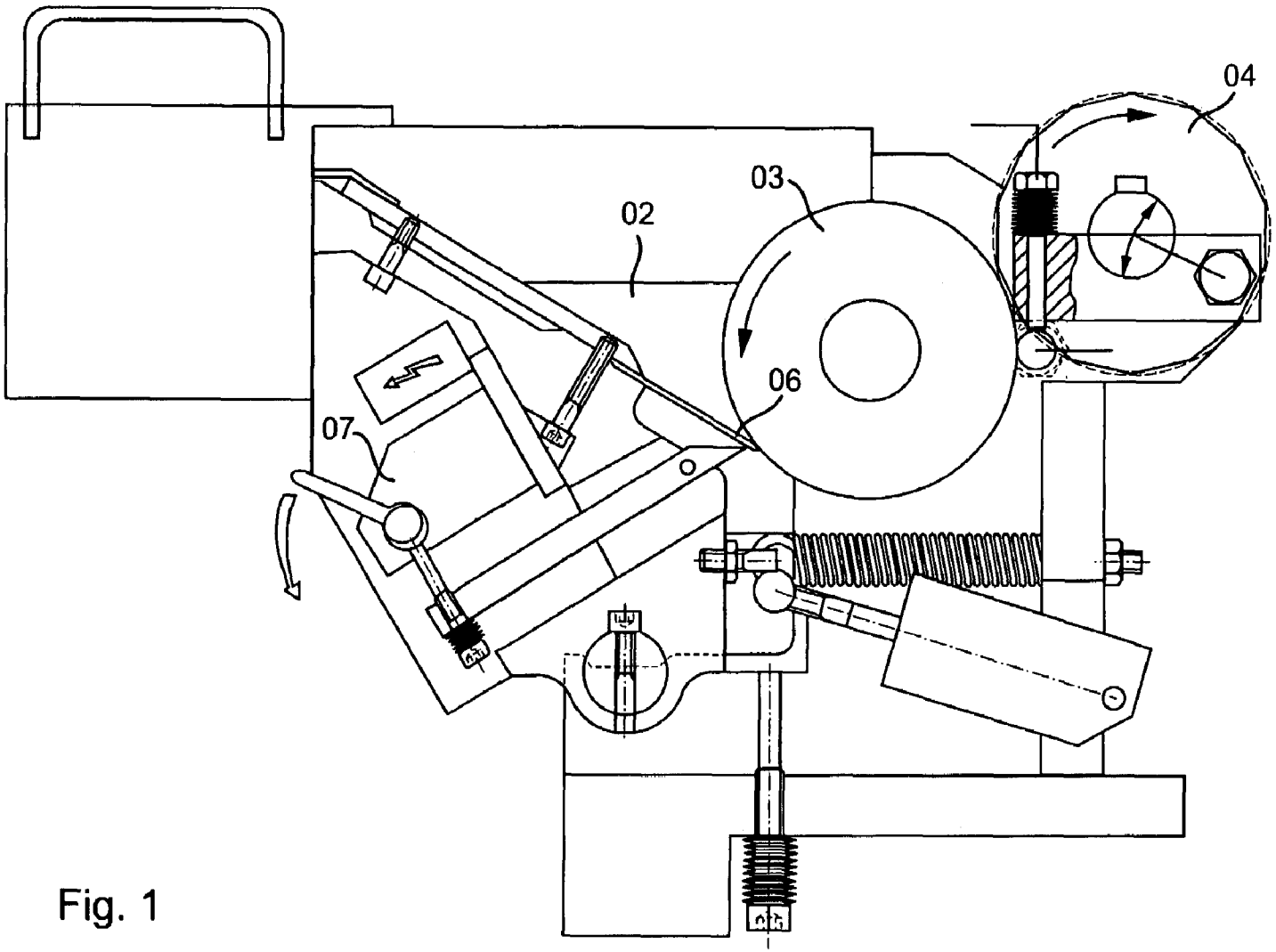
FIG. 1 a side elevation view of an inking system with an ink blade and an ink ductor; and in FIG. 2 a graphical depiction of a relative change in ink quantity across the ink zone opening of the ink system taken in accordance with FIG. 1.

An inking system 01 for a printing press, for use in dosing printing ink 02, is shown in a side elevation view in FIG. 1. An ink ductor 03 is driven in a rotary fashion such that its outer circumference rotates past a reservoir of the printing ink 02. An ink layer of a certain layer thickness is thereby formed on the outer circumference of ink ductor 03. The printing ink 02 is subsequently removed from the ink ductor 03 by a film roller 04 and is subsequently conveyed further in the direction of the printing zone of the printing press, which is not specifically shown.

A dosing device 06, such as, for example, an ink blade 06, is used to dose or to control the quantity of ink which is transferred by the inking system 01. The ink blade 06 is mounted in an adjustable fashion such that an ink zone opening S1; S3 as depicted graphically in FIG. 2, and which is defined as a space between a front edge of the ink blade 06 and the outer circumference of the ink ductor 03, may be altered. In the case of a large ink zone opening S1; S3, a large amount of printing ink 02 is transferred from the ink reservoir to the ink ductor 03. Only a small quantity of ink is transferred in the case of a small ink zone opening S1; S3.

The preferred embodiments refer to a single ink blade. In the axial direction of the ink ductor 03, it will be understood that the dosing device 06 typically has several of these ink blades 06, which plurality of ink blades 06 are each adjustable independently of one another, and to which plurality of ink blades 06 all of the embodiments of this invention apply.

In order to be able to control the ink blade 06 remotely, an adjustment element, and in particular an adjustment motor 07, is used. By using this adjustment motor 07, the ink zone opening S1; S3, between the front edge of the ink blade 06 and the outer circumference of the ink ductor roller 03 may be made larger or smaller. A sensor mechanism may be present in the adjustment motor 07. This sensor mechanism, which is not specifically shown, will allow the current position of the ink blade 06 to be measured or derived. As an alternative, it is also possible for each change in the position of the ink blade 06 from a baseline setting to be saved in the control mechanism, so that the current position of the ink blade 06 can thereby be derived.

If an adjustment is to be made to the adjustment element, in the control station of the printing press, in order to change the quantity of ink being dispensed by the inking system 01, such as, for example, by entering a certain adjustment value E1; E2; E3; E4 on a console in the control station of the printing press, then initially, the current setting of the ink blade 06 is queried by the control system. This current setting is correlated with the desired adjustment of the adjustment element, which has been entered in the control station. A subsequent adjustment of the ink blade 06 then occurs, which subsequent adjustment is made dependent upon this correlation. The mode of operation for this type of method will be explained in the following discussion, and taken with reference to the graph shown in FIG. 2.

Figure 2:
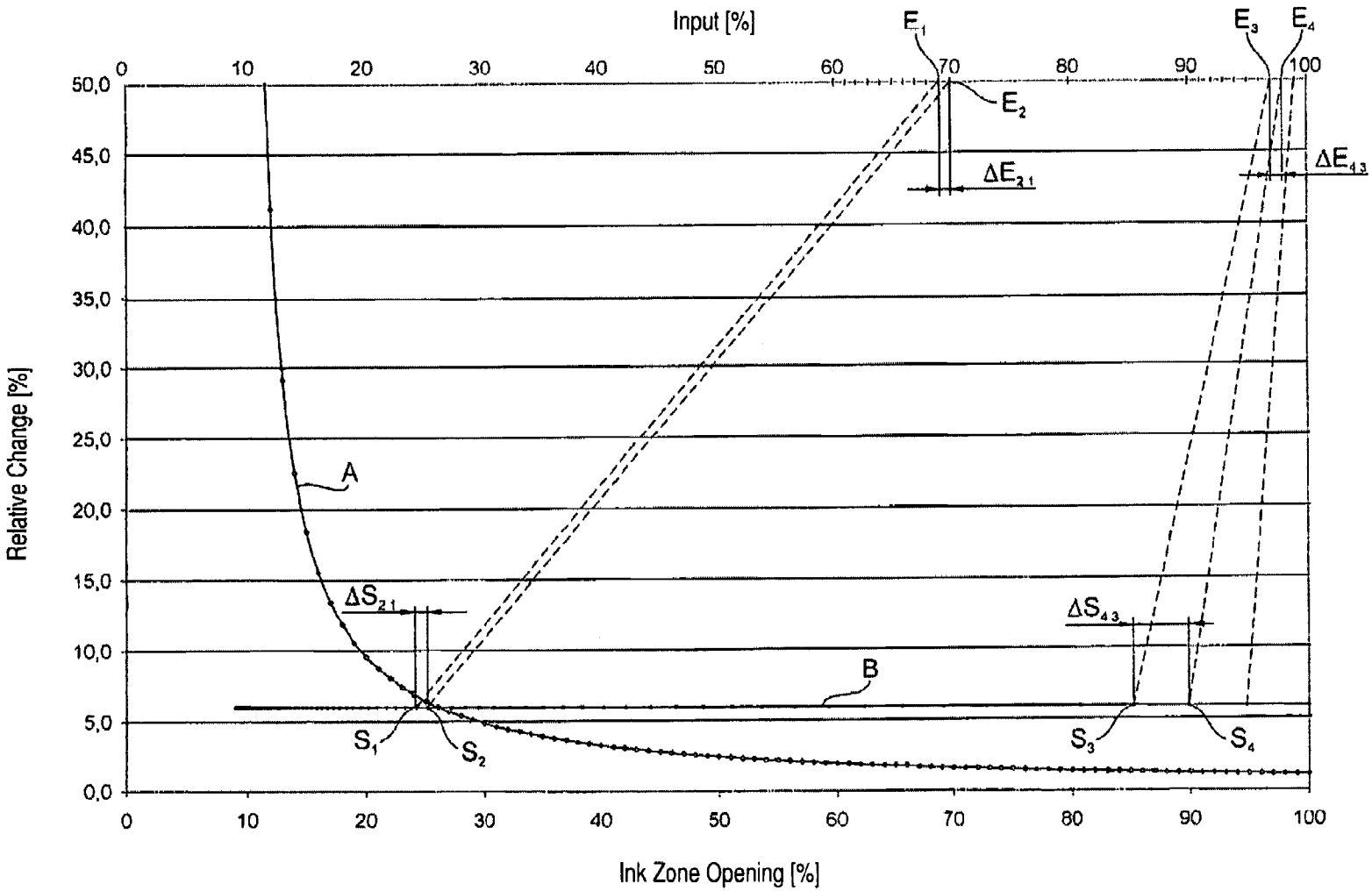

A relative change to a thickness of the ink layer on the ink ductor 03, across the ink zone opening S1; S3, between the front edge of the ink blade 06 and the outer circumference of the ink ductor 03 is shown in FIG. 2. As seen in FIG. 2, a function labeled A represents a relationship that results after the application of an adjustment method. Specifically, and in accordance with this adjustment method, an adjustment range of the input for the adjustment motor 07 is divided into several parts, such as, for example, into 100 steps, each of which steps corresponds to a certain point on the function labeled A. A distance between each of these points in the direction of the x-axis, which direction is representing the input E1; E2; E3; E4 for the ink zone opening S1; S3 is equidistant. Here, the input value is proportional to the adjustment range of the adjustment motor. This means that each one of the adjustment stages causes an equally-sized change in the layer thickness on the ink ductor 03. As a result, this leads to the function labeled A taking on a hyperbolic shape, when the relative change in layer thickness is plotted out over the ink zone opening S1; S3.

In addition, FIG. 2 also shows a function labeled B, which function B results from the ink dosing quantity method in accordance with the invention. The adjustment range of the adjustment motor 07 is again divided into 100 stages, which stages are shown as points on the function labeled B. A distance between each of these successive 100 points, on the function labeled B, and taken in the direction of the axis of the ink zone opening S1; S3 is not equidistant. Instead, this distance increases as the ink zone opening S1; S3 increases. This is based on the fact that the correlation between each change to the ink zone opening ΔS12; ΔS34 is always made dependent upon the current ink zone opening S1; S3, such that the relative change in ink layer thickness relative change=change to the ink zone opening/current ink zone opening remains constant at approximately 7%.

The input for the adjustment range is divided into equidistant stages here as well. However, an equally large change to the input for the adjustment range, at a smaller ink zone opening ΔE12; ΔE34 also causes a smaller change to the ink zone opening ΔS12; ΔS34 than a corresponding change to the input for the adjusting range in the case of a larger ink zone opening ΔE12; ΔE34. As a result, therefore, the method according to the present invention, will be able to dose in a very sensitive manner in the case of lower ink layer thicknesses. A relatively coarse dosing of the ink will occur at higher ink layer thicknesses, such as, for example, in the case of a wider ink zone opening S1; S3.

The values for the input E1; E2; E3; E4 for adjusting the adjustment element in, for example, equidistant, preferably discrete stages, are given on the upper axis of FIG. 2. An initial setting, with a small ink zone opening S1, is labeled as E1 on the graph and is changed, for example, to the point labeled E2, so that the input is changed by ΔE21, which change causes a change in the ink zone opening from S1 to S2, or, by ΔS21:

$$E2-E1=\Delta E21;\ S2-S1=\Delta S21$$

At a second setting, with a larger ink zone opening S3, the point labeled E3 is changed, for example, to the point E4, or by ΔE43, which change causes a change in the ink zone opening from S3 to S4, or by ΔS43:

$$E4-E3=\Delta E43;\ S4-S3=\Delta S43$$

Here, ΔE21=ΔE43 is preferably equal, or they differ from one another by a maximum of 10%, and in particular by a maximum of 5%.

In contrast, the ink zone openings S1; S3 which are caused thereby differ by ΔS21 and ΔS43, and preferably by at least 5% or by at least 10%.

While a preferred embodiment of a method for dosing quantities of ink in an inking system of a printing press, in accordance with the present invention, has been set forth fully and completely hereinabove, it will be apparent to one of skill in the art that various changes in, for example, the type of ink being used, the structure of the ink ductor and the like could be made without departing from the true spirit and scope of the present invention which is accordingly to be limited only by the appended claims.

What is claimed is:

1. A method for dosing a quantity of ink in an inking system of a printing press including:

providing at least one ink dosing device in said inking system;

providing at least first and second ink zone openings in said at least one ink dosing device;

setting said first ink zone opening at a first magnitude and said second ink zone opening at a second magnitude different from said first magnitude;

using said at least first and second ink zone openings in said ink dosing device for controlling first and second quantities of ink transferred by said inking system;

providing an ink adjustment device and having an adjustment range for each of said at least first and second ink zone openings in said ink dosing device;

dividing said adjustment range of each said adjustment device into a number of adjustment stages, each of a different magnitude, for each of said at least first and second ink adjustment devices;

using each of said ink adjustment devices for effecting a change in said ink quantity transferred by each of said first and second ink zone openings in said at least one ink dosing device;

determining a current setting of each of said at least first and second ink zone openings in said ink adjustment device;

determining a quantity of ink being transferred by each of said at least first and second ink zone openings in said ink dosing device at said current setting;

defining a predetermined correlation between said current setting of each of said at least first and second ink zone openings and a desired changed setting of each of said at least first and second ink zone openings;

applying a first adjustment input to said first ink zone adjustment device for changing said first magnitude of said opening of said first ink zone opening to a changed first magnitude;

applying a second adjustment input to said second ink zone device for changing said second magnitude of said opening of said second ink zone opening to a changed second magnitude;

using said defined predetermined correlation for selecting said stages of adjustment of unequal magnitude applied to each said at least first and second ink zone openings in said ink dosing device;

keeping a number of said first stages of adjustment and said second stages of adjustment the same and obtaining said first and second changed magnitudes different from each other;

maintaining an essentially constant ratio between said change in said ink quantity transferred by each of said at least first and second ink openings in said ink dosing device, as caused by an adjustment of said ink dosing device, relative to said current quantity of ink being transferred by each of said at least first and second ink openings in said ink dosing device at said current setting, using said predetermined correlation; and maintaining said essentially constant ratio with a variance of less than 2% over an entire dosing range of said ink dosing device including said at least first and second ink zone openings.

2. The method of claim 1 further including maintaining said ratio essentially constant over an entire dosing range of said dosing device and over said adjustment range of said ink adjustment device.

3. The method of claim 1 further including providing said changed first magnitude and said changed second magnitude differing by at least 5%.

4. The method of claim 1 further including providing said first magnitude and said second magnitude differing by at least 10%.

5. The method of claim 1 further including providing said number of adjustment stages as equidistant steps over said adjustment range.

6. The method of claim 5 further including providing a push button and inputting said equidistant steps using said push button.

7. The method of claim 1 further including providing a viewing screen and using said viewing screen for displaying said number of adjustment stages.

8. The method of claim 7 further including specifying values of said number of adjustment stages on said viewing screen.

9. The method of claim 1 further including providing a control station and using said control station for adjusting said ink adjustment device.

10. The method of claim 1 further including providing said first adjustment input and said second adjustment input being the same.

11. The method of claim 1 further including providing an ink ductor as said ink dosing device and using said ink adjustment device for changing an ink thickness layer transferred by said ink ductor.

12. The method of claim 11 further including an ink blade and using said ink blade for changing said ink thickness layer on an outer diameter of said ink ductor.

13. The method of claim 11 further including maintaining a relative thickness of said ink layer transferred by said ink ductor constant over an entire dosing range of said dosing device.

14. The method of claim 1 further including maintaining said ratio at less than 1%.

15. The method of claim 1 further including maintaining a relative change in said quantity of ink transferred by said dosing device essentially constant.

* * * * *